US006150958A

United States Patent [19]

Worsham

[11] Patent Number: 6,150,958

[45] Date of Patent: Nov. 21, 2000

[54] REMOTE CONTROLLED PARKING BARRIER APPARATUS

[75] Inventor: Robert J. Worsham, Morton, Wash.

[73] Assignee: Criminalistics, Inc., Morton, Wash.

[21] Appl. No.: 09/334,685

[22] Filed: Jun. 17, 1999

[51] Int. Cl.[7] ..... B60Q 1/48

[52] U.S. Cl. ..... 340/932.2; 404/6; 116/63; 40/618

[58] Field of Search ..... 340/932.2, 908.1; 404/6, 9, 10; 116/63 P, 63 C, 63 R, 212, 173, 174, 175; 40/618, 612

[56] References Cited

U.S. PATENT DOCUMENTS

| | | | |
|---|---|---|---|
| 3,673,734 | 7/1972 | Goldberg | 49/35 |
| 3,748,782 | 7/1973 | Reynolds | 49/49 |
| 3,849,936 | 11/1974 | Geraci . | |
| 4,713,910 | 12/1987 | Quante . | |
| 4,879,554 | 11/1989 | Diaz-Silveira | 340/932.2 |
| 4,894,654 | 1/1990 | Serenbetz | 340/932.2 |
| 4,901,071 | 2/1990 | Fletcher | 340/932.2 |
| 4,934,097 | 6/1990 | Quante . | |
| 5,438,799 | 8/1995 | Le Faucheur | 49/49 |
| 5,711,110 | 1/1998 | Williams . | |

FOREIGN PATENT DOCUMENTS

| | | |
|---|---|---|
| 0 433 052 A1 | 8/1991 | European Pat. Off. . |
| 54-33341 | 3/1979 | Japan . |

*Primary Examiner*—Jeffery A. Hofsass
*Assistant Examiner*—Daniel Previl
*Attorney, Agent, or Firm*—Nixon Peabody LLP; Thomas W. Cole

[57] ABSTRACT

A radio-operated parking barrier apparatus is provided that includes a base housing, a barrier arm including a shaft rotatably mounted in the housing, and a drive assembly disposed within the base housing that includes a pivot arm having a proximal end affixed to the shaft, and a driver having a reciprocally driven plunger movably connected to a distal end of the pivot arm. The back end of the driver is pivotally connected to the floor panel of the base housing to accommodate the vertical movement of the accurate motion that the end of the plunger must necessarily follow in converting the linear movement of the plunger into the rotation movement of the barrier arm around the shaft mounted in the base housing. The driver preferably utilizes a threaded shaft and drive nut to reciprocate the driver in operating the device. The drive assembly provides a simple and reliable linkage between the barrier arm and the base housing.

26 Claims, 4 Drawing Sheets

REMOTE CONTROLLED PARKING BARRIER APPARATUS

BACKGROUND OF THE INVENTION

The invention is generally concerned with parking barriers, and is specifically concerned with a battery operated, remote controlled parking barrier apparatus having a simple and reliable drive assembly for lifting and lowering a barrier arm.

Remote controlled parking barrier devices are known in the prior art. Such devices generally comprise a support base which is mountable in front of a parking space, and a barrier pivotally connected to the base that is movable into and out of a vehicle obstructing position. The mounting base contains an electric motor, a linkage for converting the rotational movement of the motor shaft into a pivoting movement of the barrier, and a radio-operated battery power supply for remotely actuating the electric motor to lift or lower the barrier connected to the mounting base.

Such parking barrier devices advantageously allow a parking lot or parking garage to reserve individual spaces for VIP's or other individuals. In operation, the mounting base of the device is bolted or otherwise secured on the floor or ceiling of the garage in front of the space to be reserved. The barrier (whether an arm or other structure) is then positioned so as to effectively block an intruding vehicle from entering the reserved space. The person for whom the space is reserved for is given a radio-operated controller not unlike a garage door opener. When a button on the controller is manually depressed, a coded radio signal is transmitted which causes battery power to be supplied to the electric motor within the mounting base of the unit. The motor, through the linkage, proceeds to pivot the barrier out of the vehicle obstructing position (i.e., usually toward the floor of the parking garage). Such parking barrier devices are becoming increasingly popular as they are easily installed, and are effective in reserving parking spaces without the need for a human attendant or an external supply of electrical power. Examples of such devices are disclosed in U.S. Pat. Nos. 5,438,799, 4,934,097, and 4,713,910.

Even though such parking barrier devices are capable of achieving their intended function, the applicant has noted a number of areas in which they might be improved.

For example, many prior art barrier devices utilize a fairly complex linkage between their respective electric motors and barrier arms to lift and lower the arms into and out of a traffic obstructing position. U.S. Pat. Nos. 5,438,799 and 4,713,910 disclose linkages formed from telescopically inter fitting, slotted rails in combination with a cam arrangement, and a rack and pinion, and, pulley and cable arrangement, respectively. Each of these linkages includes a counterweight to minimize the amount of electrical energy needed to lift and lower their respective barrier arms. The mechanical complexity of such linkages not only increases the effort and expense associated with the manufacture of these devices, but also reduces their reliability by providing multiple points where the linkage can jam or otherwise malfunction over time as a result of wear or corrosion.

While U.S. Pat. No. 4,934,097 discloses a somewhat simpler linkage that advantageously uses a motion screw assembly, a plurality of precision made cams is necessary to effect the pivoting motion of the barrier arm. Additionally, the motion screw assembly is located in the barrier arm itself, thereby greatly increasing the weight and hence the power requirement to lift and lower the barrier arm.

In all three of the aforementioned prior art examples, a substantial amount of time and effort is needed to properly adjust the linkage during the assembly of the device so that the barrier arm of the respective device moves within its intended angular limits. Unfortunately, this substantial adjustment effort must be repeated when the arm is accidentally pushed out of alignment. Finally, many prior art devices of this type have no satisfactory provision for preventing damage to the linkage and power supply when the barrier is accidentally blocked during movement. Such a situation might occur if the barrier was actuated while a vehicle was standing in the path of movement of the arm.

Clearly, what is needed is a remote controlled parking barrier device that utilizes a simpler and more reliable linkage between its barrier arm and the electric motor which drives it. Preferably, none of the linkage components would be installed within or attached to the barrier arm itself so as to minimize the weight of the arm and hence the amount of electric power necessary to lift it to a traffic obstructing position. It would be desirable if the linkage of such a device were simple and inexpensive to manufacture and easily adjusted during assembly so that the barrier arm in the final product moved exactly between its intended angular limits. Finally, such a device should have a mechanism for preventing damage to the linkage or circuitry in the event the arm is accidentally obstructed during its movement.

SUMMARY OF THE INVENTION

Generally speaking, the invention is a remote controlled parking barrier apparatus that overcomes or ameliorates all of the aforementioned shortcomings associated with the prior art. The apparatus of the invention comprises a base housing, a barrier arm including a shaft rotatably mounted in the housing, and a drive assembly disposed within the base housing including a pivot arm having a proximal end fixed to the shaft, and a driver having a reciprocally driven plunger connected to a distal end of the pivot. The plunger is rotatably connected to the distal end of the pivot arm, while the driver is pivotally connected to a bottom wall of the base housing. The resulting simple linkage allows the plunger of the driver to rotate the pivot arm the 90° necessary to swing the barrier arm from a horizontal to a vertical position in a mechanically reliable manner with a minimum number of mechanical components.

In the preferred embodiment, the driver extends and retracts its plunger via a riding nut mechanism wherein the plunger is connected to a threaded rod, and the driver includes a reversible DC motor for rotating a nut engaged to the threads of the rod in either a clockwise or counterclockwise direction to extend or retract the plunger with respect to the housing of the driver. While other types of driver mechanisms may be used to implement the invention (i.e., electric solenoids, hydraulic or pneumatic cylinders, etc.) a riding nut-type driver powered by an electric motor is preferred due to the precision to which the stroke of the plunger may be controlled, the energy efficiency of such a mechanism, and the lack of backlash and mechanical slack between the rotating nut and the threads of the rods that move the plunger.

The parking barrier apparatus may include an adjustment mechanism for adjusting the length of the pivot arm and hence the angular stroke of the barrier arm. In the preferred embodiment, the pivot arm may be formed from one or two eyebolts whose heads are pivotally connected to the end of the plunger. In such a case, the adjustment mechanism is formed by the threaded ends of the eyebolts, which are screwed into the shaft that is rotatably mounted in the base housing to which the legs of the barrier arm are connected to. The angular stroke of the barrier arm may be easily shortened or lengthened by screwing the eyebolts forming the pivot arm either farther into or farther out of the rotatable shaft.

The reversible DC motor of the driver is preferably connected to an electrical power supply via a radio controlled switching circuit so that the barrier arm may be moved from a horizontal to a vertical position and back again by means of a radio-operated controller similar to that of a garage door opener. A solar battery panel is preferably mounted on the upper wall of the base housing to continuously recharge the battery supply. The barrier arm preferably includes an electrically conductive material that functions as an antenna for the radio-controlled switching circuit to improve the range and sensitivity of the switching circuit without the addition of any extra electrical components. Finally, an overload circuit is connected between the battery pack and the DC motor of the driver for reversing the unit upon the occurrence of an electrical overload condition which may be caused, for example, by an obstruction of the barrier arm.

The invention advantageously provides a remote controlled parking barrier apparatus that is mechanically simple and reliable and electrically self-sufficient for long periods of time. Moreover, the parking barrier device is simple and inexpensive to manufacture and easily adjusted during assembly so that the barrier arm in the final product moves exactly between its intended angular limits. Finally, the overload detection circuit prevents damage to both the linkage and the circuitry in the event that the arm is accidentally obstructed during its movement.

BRIEF DESCRIPTION OF THE SEVERAL FIGURES

DETAILED DESCRIPTION OF THE PREFERRED EMBODIMENT

Figure 1:
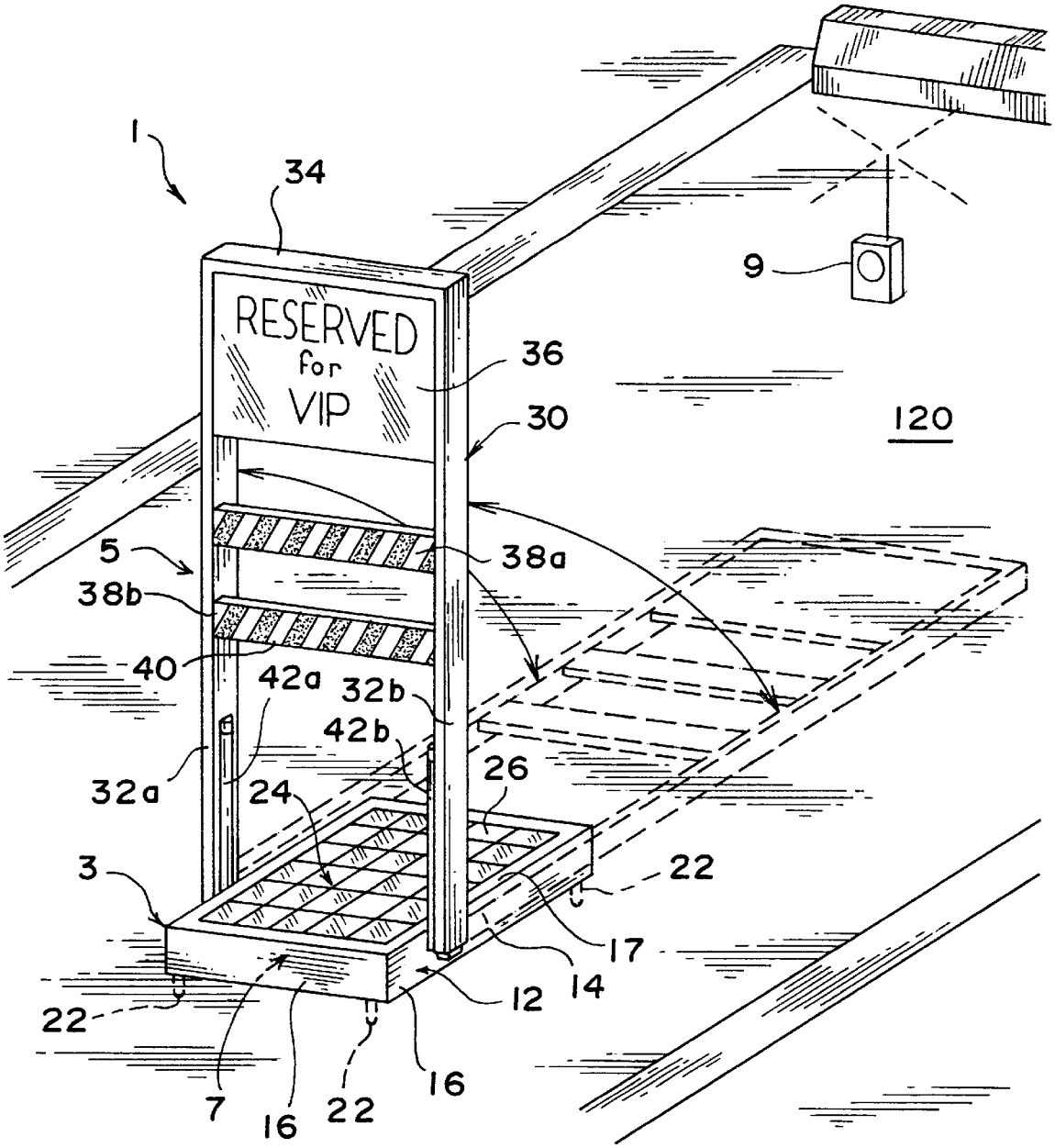
FIG. 1 is a perspective view of the parking barrier apparatus of the invention shown in operation in a parking lot.
Figure 2:
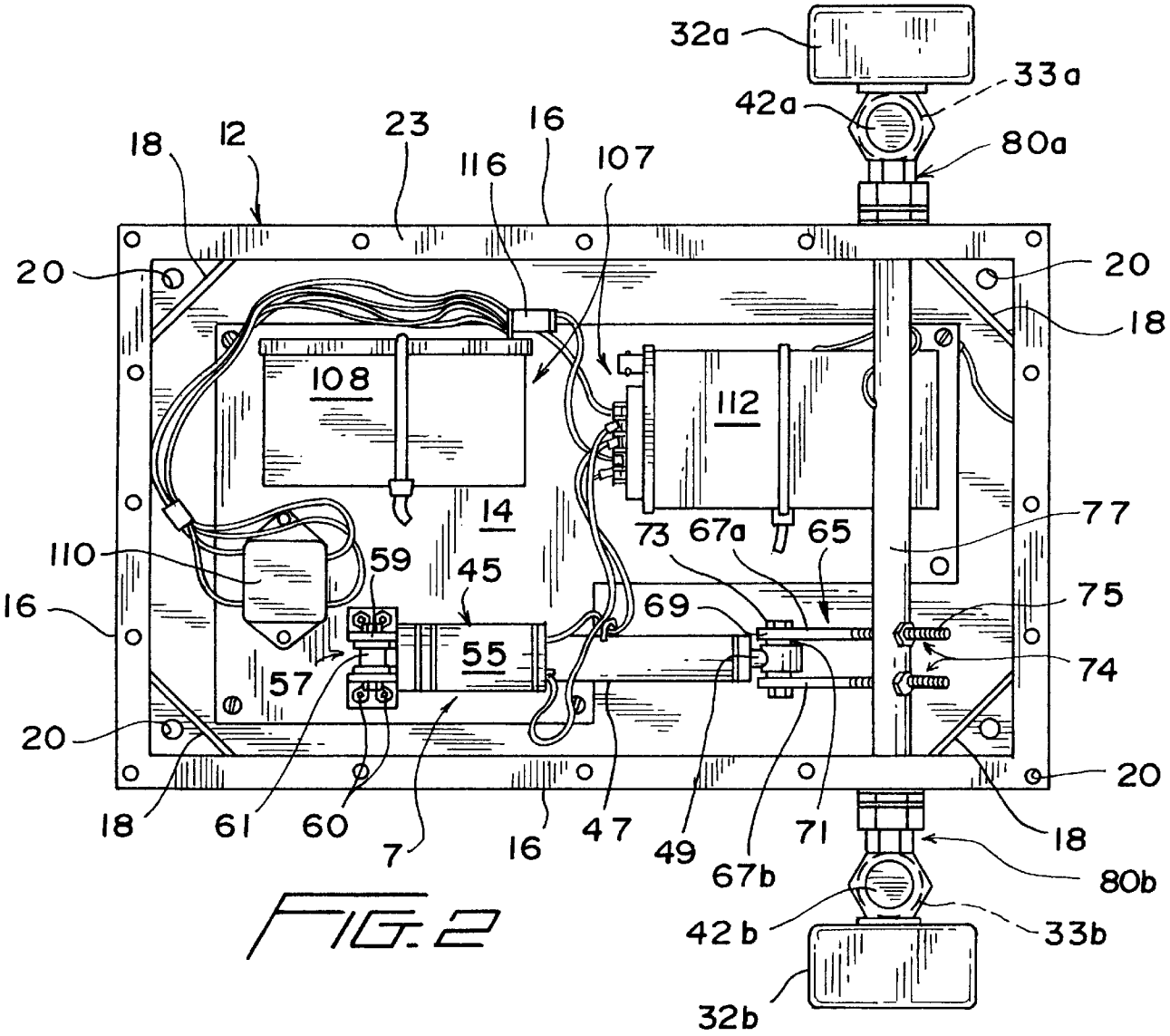
FIG. 2 is a plan view of the base housing of the apparatus shown with its upper lid removed to display the driver assembly disposed therein.

With reference to FIGS. 1 and 2 wherein like numerals designate like components throughout all of the several Figures, the parking barrier apparatus 1 of the invention generally comprises a base housing 3, a barrier arm 5, and a drive assembly 7 contained within the base housing 3 for moving the arm 5 between a vertical and horizontal position as indicated in phantom in FIG. 1. A radio actuator 9 similar in structure and design to a garage door opener actuates the drive assembly 7 to move the arm 5 into a horizontal, vehicle-admitted position, or a vertical, vehicle-obstructing position as indicated in FIG. 1. While the apparatus 1 is illustrated as being mounted on the floor of a parking lot, it may also be mounted on the ceiling when the lot is located within a parking garage.

The base housing 3 is formed from a rectangular enclosure 12 having a floor 14, side walls 16, and a lid 17, all of which are preferably formed from 14 gauge galvanized sheet material. Preferably, the corners and edges of the rectangular enclosure 12 are formed by seam welding to render the enclosure strong and moisture proof. Corner moisture barriers 18 are added to prevent water from entering the enclosure from bolt holes 20. Corner barriers 18 also give the enclosure 12 sufficient compressive strength to remain intact should the wheels of an automobile run over it. Bolt holes 20 are provided in the corners of the enclosure 12 to accommodate mounting bolts 22 that secure the enclosure 12 to the floor (or ceiling) of a parking lot, as illustrated in FIG. 1. As is shown in FIG. 2, an upper flange 23 is provided around the top ends of the side walls 16 for supporting the lid 17, which is attached thereon via "snake eye" screws to discourage unauthorized removal. In the preferred embodiment, the lid 17 supports, on its upper surface, a solar panel 24 that is covered by a protective plastic sheet 26 preferably formed from Lexan®. Solar panel 24 is preferably a 10½ inch by 17½ inch 17.1 volt, 0.58 amp unbreakable solar panel. As will be described in more detail hereinafter, the solar panel 24 forms part of the electric power supply 107 of the drive assembly 7.

The barrier arm 5 includes a frame 30 (which may be made of wood) having a pair of parallel, opposing legs 32*a,b*. A header 34 connects the top ends of the legs 32*a,b*, and an identifying sign 36 may be mounted in the upper portion of the frame 30 as shown. Reinforcing members 38*a,b* having reflective material 40 are used to both reinforce the frame 30 and to render it more easily visible under low light conditions. The bottom ends of the frame legs 32*a,b* are connected to drive posts 42*a,b* which in turn are operated by the drive assembly 7 in a manner to be described shortly. In the embodiment illustrated in FIG. 1, such connection may be made by brackets or screws (not shown) that secure the upper ends of the drive posts 42*a,b* to the bottom ends of the frame legs 32*a,b*. Alternatively, such connection may be made by forming the legs 32*a,b* from a tubular element such as tubular PVC 33*a,b* (shown in phantom in FIG. 2), and sliding the open ends of such legs over the tubular bodies forming the drive posts 42*a,b*.

Figure 3:
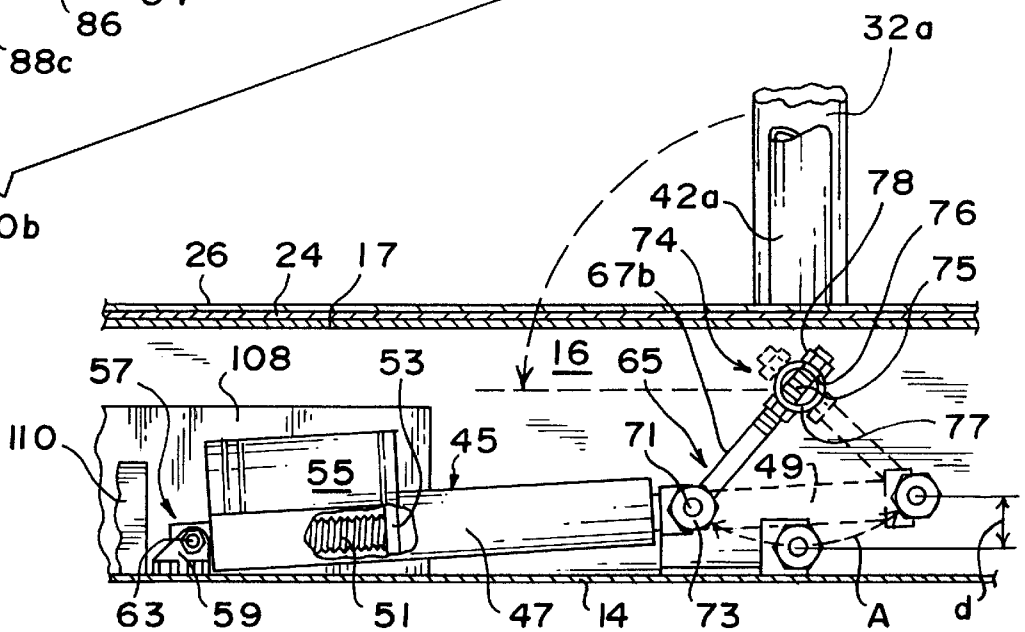
FIG. 3 is a side view of the drive assembly illustrating how the pivot arm is moved 90° by the plunger of the pivotally mounted driver.

With reference now to FIGS. 2 and 3, the drive assembly 7 includes a driver 45 having a cylindrical housing 47. A reciprocating plunger 49 is extendable from and retractable into the housing 47. As is partially illustrated in FIG. 3, plunger 49 is connected to a threaded rod 51 which in turn is circumscribed by a drive nut 53. Threaded rod 51 is circumscribed by an acme thread to minimize backlash. The drive nut 53 is connected to the output shaft of a reversible, DC motor 55 via a gear train (not shown). When the nut 53 is rotated within the housing 47, the threadedly engaged rod will either extend or retract, depending upon the direction of rotation of the nut. In the preferred embodiment, the driver 45 is a Model No. S12-17A8-04CE driver manufactured by Warner Electric, Inc. located in Marengo, Ill. Such a driver has a stroke of 4 inches, a load capacity of 75 pounds, and requires a maximum current of 5⅔ amps and is protected by a 6 amp fuse (not shown) contained within housing 47. The 4 inch travel of the plunger 49 is limited by limit switches contained within the housing 47 (also not shown).

The distal end of the cylindrical housing 47 of the driver 45 is connected the floor panel 14 of the rectangular enclosure 12 by means of a pivoting driver mounting 57. Mounting 57 is formed by a yoke bracket 59 connected by screws 60 to the floor panel 14. The distal end of the cylindrical housing 47 includes a mounting lug 61. A journaling bolt 63 disposed through registering bores (not shown) in the yoke bracket 59 and mounting lugs 61 pivotally connects these components together.

A pivot arm assembly 65 is disposed at the distal end of the driver 45. Pivot arm assembly 65 is formed from a pair of eyebolts 67*a,b*, the heads 69 of which are rotatably connected to the distal end of the plunger 69 of the driver 45 via bolt 71. Bolt 71 is in turn secured in position by way of nut 73 (shown in FIG. 3). Drive assembly 7 further includes a mechanism 74 for adjusting the length of the pivot arm assembly 65. Mechanism 74 is formed from the threaded ends 75 of the eyebolts 67*a,b*. Threaded ends 75 are engaged to threaded holes 76 located in rotatable barrier arm shaft 77. The shaft 77 is in turn journaled in apertures in the side walls 16 of the rectangular enclosure 12 of base housing 3. The pivot arm assembly 65 may be made longer or shorter with respect to the axis of rotation of the shaft 77 by screwing or unscrewing the threaded ends 75 either into or out of the holes 76. As has been previously indicated, the provision of such a length-adjustment mechanism 74 for the pivot arm assembly 65 greatly facilitates the assembly of the apparatus 1, since it allows the pivot arm assembly 65 to be quickly and accurately adjusted to a length consistent with a proper 90° stroke of the shaft 77. As is shown in FIG. 3, once the length of the pivot arm assembly 65 has been properly adjusted, securing nuts 78 are screwed onto the threaded ends 75 to secure the threaded ends of the I-bolts 67*a,b* into a proper depth in the shaft 77.

Figure 4A:
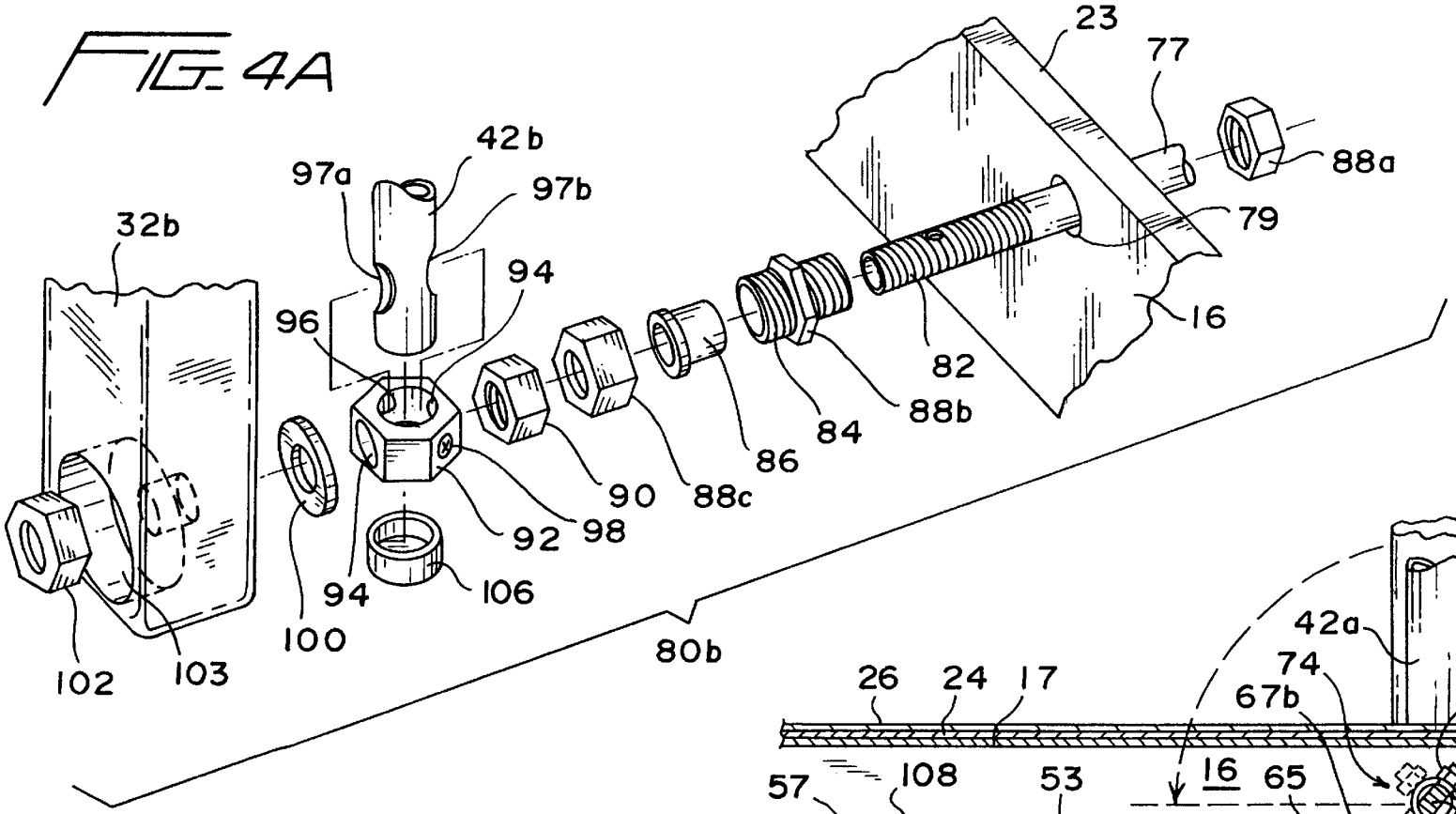
FIG. 4A is an exploded view of the coupling assembly used to interconnect the ends of the shaft that is rotatably mounted to the base housing and the legs of the barrier arm.
Figure 4B:
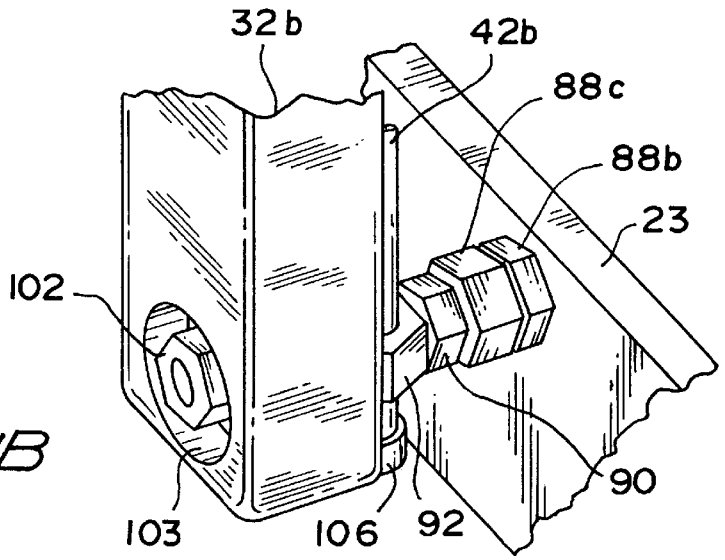
FIG. 4B is a perspective view of the coupling assembly illustrated in FIG. 4A shown in assembled form.

With reference now to FIGS. 4A and 4B, the ends of the rotatable shaft 77 are journaled within apertures 79 in opposing side walls 16 of the enclosure 12 by means of coupling assemblies 80*a,b*, of which only one (80*b*) is shown for simplicity. The ends 82 of the shaft 77 are threaded as shown. The coupling assembly 80*b* includes a threaded sleeve 84 that screws over the threaded end 82 of the shaft 77 and through the aperture 79. Conduit fitting 86 is received within the end of the threaded sleeve 84 in order to prevent moisture from penetrating the interior of the sleeve 84. Retaining nuts 88*a,b* are disposed over the ends of the threaded sleeve 84 and on either side of the aperture 79 to prevent the shaft 77 from moving axially with respect to the side wall 16 of the enclosure 12. Retaining nut 88*c* secures both the conduit fitting 86 and retaining nut 88*b* in place. Spacing nut 90 screws over the threaded end 82 of the shaft 77 and provides space between the side wall 16 of the enclosure 12 and drive post 42*b*. Collar nut 92 is also screwed over the threaded end 82 of the shaft 77 via threaded side bores 94.

Collar nut 92 includes a central bore 96 for receiving an end of one of the previously-mentioned drive post 42*b*. To better secure the end of the drive post 42*b* within the coupling assembly 80*b*, post 42*b* is provided with apertures 97*a,b* which receive the threaded end 82 of the shaft 77. A set screw bore 98 is also provided in the collar nut 92 for receiving a set screw (not shown) for clamping the end of the drive post 42*b* within the collar nut 92. The set screw includes a hexagonal recess for receiving an Allen wrench which may be used to over ride the system and lower the barrier in the event of power failure or the loss of the remote control device. A washer 100 is disposed between the collar nut 92 and the interface of frame leg 32*b*. Finally, coupling assembly 80 includes a frame mounting nut 102 that screws over the distal most portion of the threaded end 82 in order to attach the end of the frame leg 32*b* onto the drive post 42*b*. Mounting nut 102 is received within a cylindrical recess 103 provided in the end of the frame leg 32*b*. The bottom of the drive post 42*b* is capped via plastic cap 106 after the distal end of the post is inserted through the collar nut 92. While not indicated specifically in any of the drawings, it should be noted that the upper ends of both of the drive posts 42*a,b* are also screwed or otherwise secured onto the frame legs 32*a,b* so that the frame 30 of the barrier arm 5 is securely mounted onto the drive posts 42*a,b*.

Figure 5:
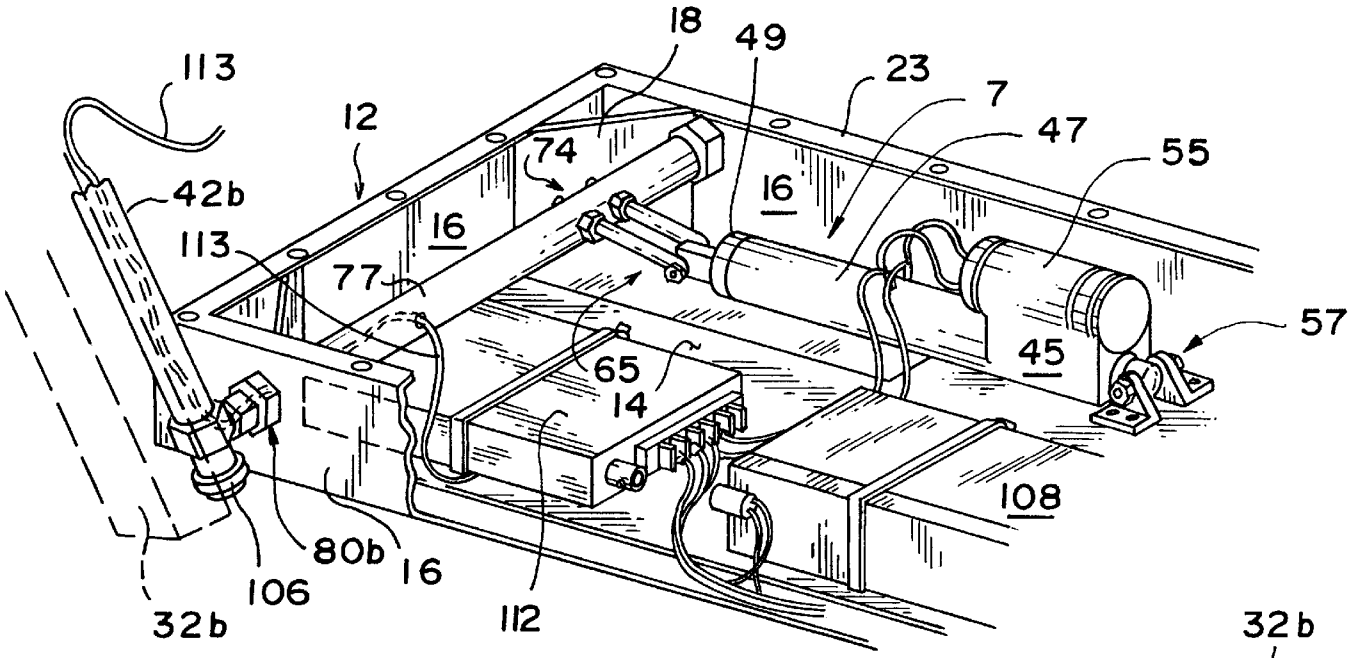
FIG. 5 is a perspective view of the drive assembly contained within the base housing, illustrating how the antenna of the radio-controlled switching circuit is threaded through the shaft and drive post that move the barrier arm.

With reference now to FIGS. 2 and 5, the electrical power supply 7 for the motor 55 of the driver 45 includes a battery pack 108 which is connected to the previously described solar panel 24 via a photovoltaic regulator 110. In the preferred embodiment, the battery pack 108 is a Model No. MP-7-12 volt Yuasa battery manufactured by the Yuasa Battery Company located in Osaka, Japan, while the photovoltaic regulator 110 is preferably a Model "Sun Selector" manufactured by Bobier Electric, Inc. located in Parkersburg, W.V. The electric motor 55 of the driver 45 is connected to the output of the battery pack 108 via a radio-controlled switching circuit 112. In the preferred embodiment, switching circuit 112 is a Model No. WR300/2B radio receiver manufactured by Visonic, Inc. located in Bloomfield, Conn., while the radio actuator 9 (illustrated in FIG. 1) is a Model No. WT-102 transmitter manufactured by the same organization. An overload circuit 116 is connected between the battery pack 108 and the motor 55 of the driver 45. This circuit reverses the polarity of the current entering the motor 55 in the event of an overload condition so as to reverse the direction that the driver 45 moves the barrier arm. A 6 amp fuse is included within the housing of the driver 45 as further overload protection. As is illustrated in FIG. 5, the antenna 113 of the radio-controlled switching circuit 112 may be strung through the hollow portion of the shaft 77 and the drive post 42*b* and continuing up into the barrier.

The operation of the apparatus 1 may best be understood with respect to FIGS. 1 and 2. When the person for whom a particular parking space 120 is reserved approaches the space in his vehicle, he depresses a button on the radio actuator 9, which is received by the antenna 113 of the radio-controlled switching circuit 112. The actuation of the circuit 112 connects the battery pack 108 of the electrical power supply 107 to the motor 55 of the driver 45. Just prior to such actuation, the barrier arm 5 of the apparatus 1 is in the vertical position illustrated in FIG. 1, and the reciprocating plunger 49 of the driver 45 is retracted into the position illustrated in FIG. 3. After the actuation of the switching circuit 112, motor 55 rotates the drive nut 53 of the driver 45 to extend the reciprocating plunger 49 into the position illustrated in phantom in order to move the barrier arm 5 from a vertical, upright position 90° into the horizontal position illustrated in phantom. As is illustrated in FIG. 3, the pivoting driver mounting 57 allows the driver 45 to pivot downwardly toward the floor panel 14 and then upwardly a distance d while the plunger 49 rotates the shaft 77 90° via pivot arm assembly 65. Hence, the linear movement of the plunger 49 of the driver 45 is smoothly converted into a 90° circular movement by the action of the pivoting mounting 57 in allowing the driver 45 to pivot up and down the distance "d," similar to the action of pneumatic door closer. When the barrier arm 5 finally arrives at the prone, horizontal position illustrated in phantom in FIG. 1, a limit switch (not shown) is tripped within the driver 45, disconnecting the motor 55 from the output of the battery pack 108 and signaling the radio-controlled switching circuit 112 that the movement cycle of the barrier arm 5 has been completed. The operator of the vehicle for whom the space has been reserved then parks his vehicle into the space 120. When the vehicle operator leaves the space 120, he again depresses the button, whereupon the radio-controlled switching circuit 112 again closes a circuit between the motor 55 and the battery pack 108, but at an opposite polarity so that the direction of the rotation of the electric motor 55 is reversed. The plunger is then withdrawn into the housing 47 of the driver 45 until the barrier arm 5 then assumes the vertical position illustrated in FIG. 1, whereupon the limit switch within the driver 45 is tripped, thereby breaking the circuit between the motor 55 and the battery pack 108. In the event that the barrier arm becomes obstructed, current sensing circuit 116 senses the resulting current overload condition and reverses the polarity of the current, thus causing the driver 45 to move the arm 7 in an opposite direction.

Although the invention has been described with respect to a preferred embodiment, various modifications, additions, and variations will become evident to those of ordinary skill in the art. All such modifications, variations, and additions are intended to be encompassed within the scope of this invention, which is limited only by the claims appended hereto.

What is claimed:

1. A parking barrier apparatus, comprising:

a base housing;

a barrier arm including a shaft rotatably mounted in said base housing, and a drive assembly disposed within said base housing, said drive assembly including a pivot arm having a proximal end affixed to said shaft for moving circularly with a rotation of said shaft, and a driver connected to said base housing by way of a pivotal connection for accommodating said circular movement of said pivot arm, said driver having a reciprocally driven plunger rotatably connected to a distal end of said pivot arm.

2. A parking barrier apparatus as defined in claim 1, wherein said driver includes a housing, and said plunger is formed in part from a rotatable threaded rod that is threadedly engaged to a nut mounted on said housing.

3. A parking barrier apparatus as defined in claim 2, wherein said driver includes a motor operably connected to said threaded rod for rotating said rod in a first direction to extend said rod from said driver housing and a second direction to retract said rod into said driver housing.

4. A parking barrier apparatus as defined in claim 1, wherein said drive assembly further includes an adjustment mechanism for adjusting the length of the pivot arm.

5. A parking barrier apparatus as defined in claim 4, wherein said adjustment mechanism includes a screw thread surrounding the proximal end of the pivot arm, and a threaded hole in said shaft, whereby the length of the pivot arm is adjusted by screwing said pivot arm into or out of said shaft.

6. A parking barrier apparatus as defined in claim 1, wherein said driver is powered by an electrical power supply.

7. A parking barrier apparatus as defined in claim 6, wherein said power supply is connected to an overload detection circuit for the detection of an electrical overload condition of said power supply.

8. A parking barrier apparatus as defined in claim 6, wherein said power supply is connected and disconnected from said driver by a radio-controlled switching circuit.

9. A parking barrier apparatus as defined in claim 8, wherein said barrier arm includes an electrically conductive material that functions as an antennae for said radio-controlled switching circuit.

10. A parking barrier apparatus as defined in claim 1, wherein said overload detection circuit includes a fuse for electrically disconnecting said driver form said power supply in the event of any overload conditions.

11. A parking barrier apparatus as defined in claim 6, wherein said electrical power supply includes a battery pack, and a photovoltaic cell for recharging the battery pack.

12. A parking barrier apparatus as defined in claim 11, wherein said electrical power supply further includes a photovoltaic regulator circuit.

13. A parking barrier apparatus, comprising:

a base housing;

a barrier arm including a shaft rotatably mounted in said housing, and a drive assembly disposed within said base housing including at least one pivot arm having a distal end and a proximal end, the proximal end being affixed to said shaft such that said arm moves circularly with a rotation of said shaft, a driver having a reciprocally driven plunger rotatably connected to the distal end of said pivot arm, said driver being connected to a wall of said base housing by way of a pivotal connection for accommodating said circular movement of said pivot arm.

14. A parking barrier apparatus as defined in claim 13, wherein said driver includes a housing, and said plunger is formed in part from a rotatable threaded rod that is threadedly engaged to a nut mounted on said housing.

15. A parking barrier apparatus as defined in claim 14, wherein said barrier arm includes a pair of tubular, parallel legs slidably mountable over drive posts connected to said rotatable shaft.

16. A parking barrier apparatus as defined in claim 14, wherein said driver includes a motor operably connected to said threaded rod for rotating said rod in a first direction to extend said rod from said driver housing and a second direction to retract said rod into said driver housing.

17. A parking barrier apparatus as defined in claim 16, wherein said driver is powered by an electrical power supply that includes a battery pack and a radio-controlled switching circuit for connecting and disconnecting the motor of said driver to said battery pack.

18. A parking barrier apparatus as defined in claim 17, wherein said barrier arm includes an electrically conductive wire material threaded through the shaft, said wire material comprising an antennae for said radio-controlled switching circuit.

19. A parking barrier apparatus as defined in claim 17, wherein said power supply further includes a photovoltaic cell for recharging said battery pack.

20. A parking barrier apparatus as defined in claim 19, wherein said electrical power supply further includes a photovoltaic regulator circuit.

21. A parking barrier apparatus as defined in claim 17, wherein said power supply is connected to an overload detection means for the detection of an electrical overload condition of said power supply.

22. A parking barrier apparatus as defined in claim 21, wherein said overload detection means includes a fuse for electrically disconnecting said driver from said power supply in the event of any overload conditions.

23. A parking barrier apparatus as defined in claim 21, wherein said overload detection means senses an obstruction as the barrier is arm rotated and automatically reverses the direction of movement of the driver to reverse the direction of rotation of the barrier.

24. A parking barrier apparatus as defined in claim 13, wherein said drive assembly further includes an adjustment mechanism for adjusting the length of the pivot arm.

25. A parking barrier apparatus as defined in claim 24, wherein said adjustment mechanism includes a screw thread surrounding the proximal end of the pivot arm, and a threaded hole in said shaft, whereby the length of the pivot arm is adjusted by screwing said pivot arm into or out of said shaft.

26. A parking barrier apparatus as defined in claim 13, wherein said housing includes watertight conduit bushings for affecting a waterproof seal between said housing and said rotatably mounted shaft.

* * * * *